United States Patent [19]

Coy

[11] Patent Number: 4,946,062

[45] **Date of Patent: * Aug. 7, 1990**

[54] VALVED CONTAINER CLOSURE

[76] Inventor: Peter Coy, 3510 S. Wakefield St., Fairlington Mews, Arlington, Va. 22206

[ * ] Notice: The portion of the term of this patent subsequent to Nov. 8, 2005 has been disclaimed.

[21] Appl. No.: 306,765

[22] Filed: Feb. 3, 1989

Related U.S. Application Data

[63] Continuation of Ser. No. 208,369, Jun. 17, 1988, Pat. No. 4,828,141, which is a continuation-in-part of Ser. No. 152,537, Feb. 5, 1988, Pat. No. 4,782,975.

[51] Int. Cl.[5] ..... A47G 19/22

[52] U.S. Cl. ..... 220/90.4; 220/90.2; 220/254; 220/380; 215/11.4; 222/212; 222/213; 222/490

[58] Field of Search ..... 220/90.2, 90.4, 90.6, 220/254, 367, 380; 215/11.4, 11.5, 18; 222/212, 213, 490; 383/49

[56] References Cited

U.S. PATENT DOCUMENTS

| | | | |
|---|---|---|---|
| D. 165,778 | 1/1952 | Olson | D36/D8 |
| 2,040,545 | 5/1936 | Byers | 215/74 |
| 2,605,026 | 7/1952 | Wagner | 222/490 |
| 2,611,515 | 9/1952 | Smith | 222/213 |
| 2,620,949 | 12/1952 | Cole | 222/490 |
| 2,622,420 | 12/1952 | Rice | 65/13 |
| 2,730,274 | 1/1956 | Brown | 222/490 |
| 2,816,548 | 12/1957 | Tupper | 128/252 |
| 3,104,787 | 9/1963 | Thompson, Jr. | 222/490 |
| 3,107,035 | 10/1963 | Cholet | 222/213 |
| 3,165,241 | 1/1965 | Curry | 222/490 |
| 3,191,820 | 6/1965 | Kuster | 222/490 |
| 3,481,513 | 12/1069 | Ram | 222/490 |
| 3,610,477 | 10/1971 | Herzig | 222/213 |
| 3,739,938 | 6/1973 | Paz | 220/90.4 |
| 3,773,233 | 11/1973 | Souza | 222/490 |
| 4,121,731 | 10/1978 | Okerstrum | 220/90.4 |
| 4,133,457 | 1/1979 | Klassen | 220/490 |
| 4,184,604 | 1/1980 | Amberg et al. | 220/254 |
| 4,239,123 | 12/1980 | Lang et al. | 220/90.6 |
| 4,345,695 | 8/1982 | Galloway et al. | 220/254 |
| 4,350,260 | 9/1982 | Prueher | 220/254 |
| 4,356,935 | 11/1982 | Kamin | 222/490 X |
| 4,408,702 | 10/1983 | Horvath | 222/212 |
| 4,415,097 | 11/1983 | Meins | 220/90.4 |
| 4,428,498 | 1/1984 | Obey | 220/367 |
| 4,589,569 | 5/1986 | Clements | 220/380 |
| 4,596,341 | 6/1986 | Bruffey | 220/90.4 |
| 4,623,069 | 11/1986 | White | 215/11 R |
| 4,640,424 | 2/1987 | White | 215/11 R |
| 4,714,173 | 12/1987 | Ruiz | 220/90.4 |
| 4,756,440 | 7/1988 | Gartner | 220/90.4 |
| 4,782,975 | 11/1988 | Coy | 220/90.2 |

*Primary Examiner*—Stephen Marcus
*Assistant Examiner*—Nova Stucker
*Attorney, Agent, or Firm*—Volpe and Koenig

[57] ABSTRACT

A container closure lid having a valved spout is disclosed. The valve is normally closed so as to prevent spillage from the container. In use, the valve is opened by the application of force laterally to the edge of the valve. In addition, a valved spout which is particularly adapted to permit close stacking of the lids is disclosed.

5 Claims, 5 Drawing Sheets

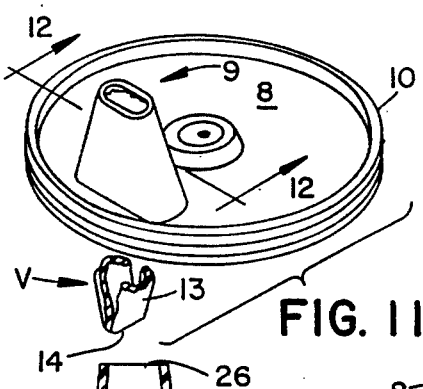
FIG. 11
FIG. 12
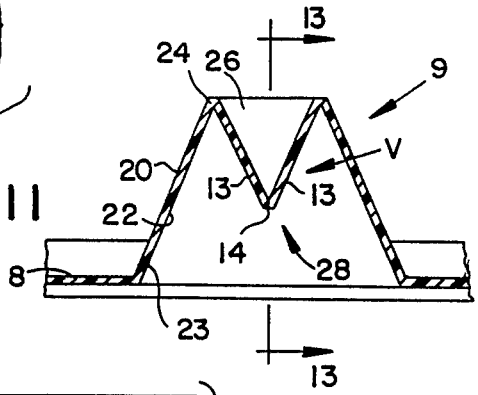
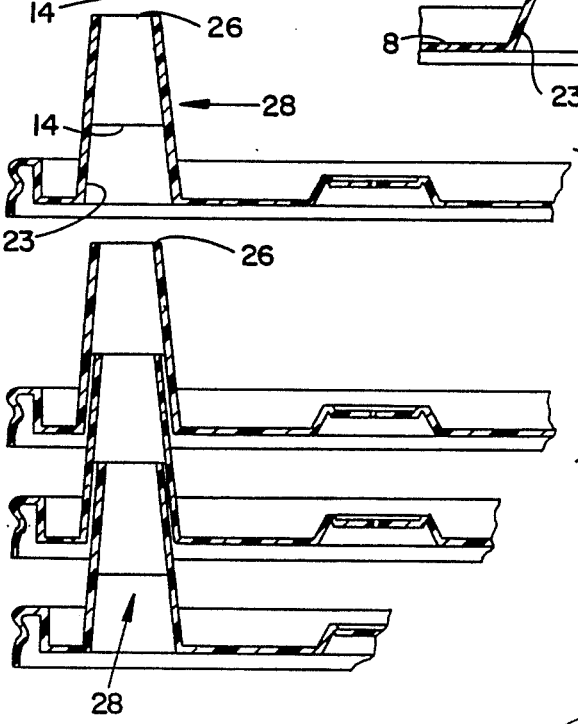
FIG. 13
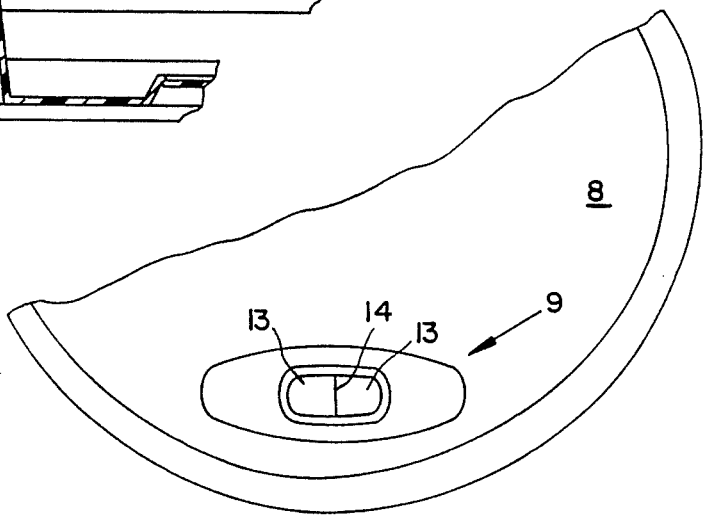
FIG. 14

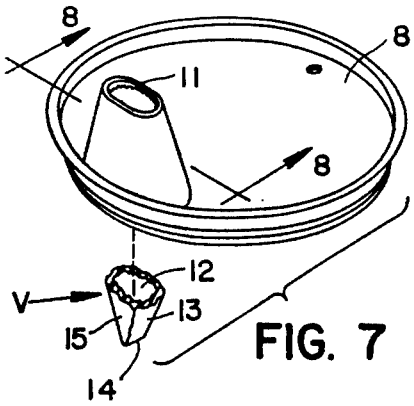
FIG. 7
FIG. 8
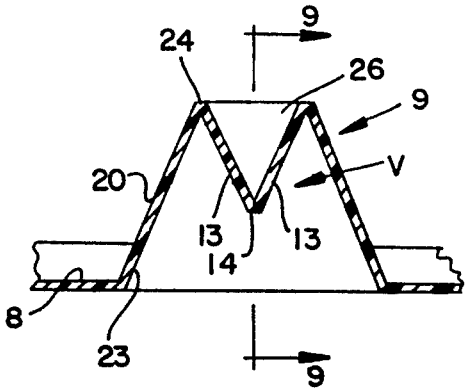
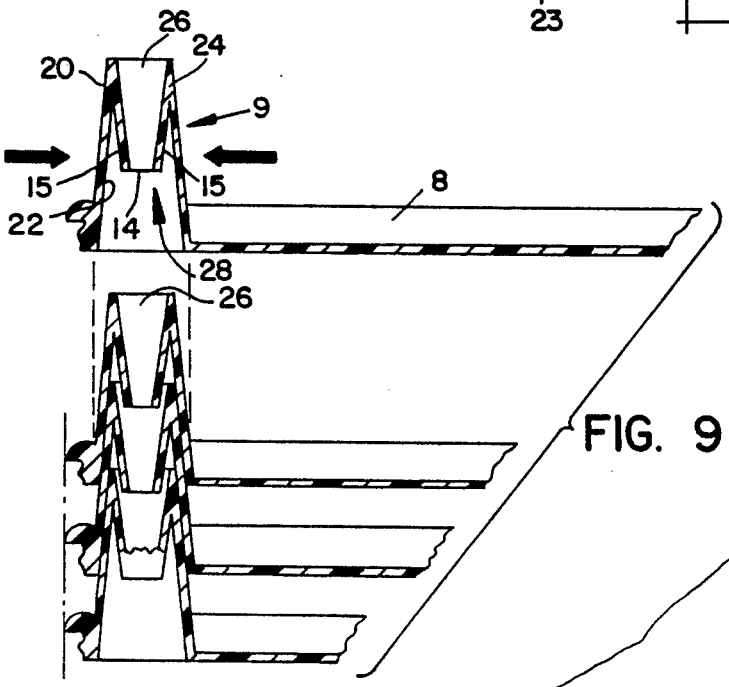
FIG. 9
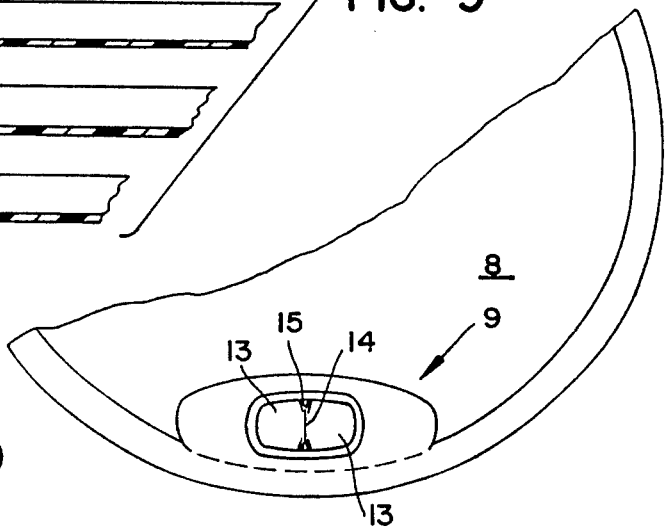
FIG. 10

FIG. 15
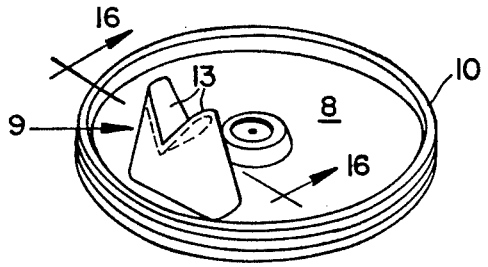
FIG. 16
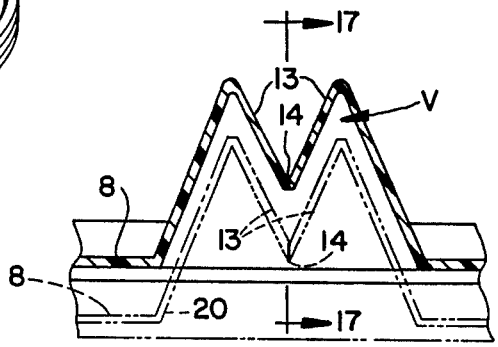
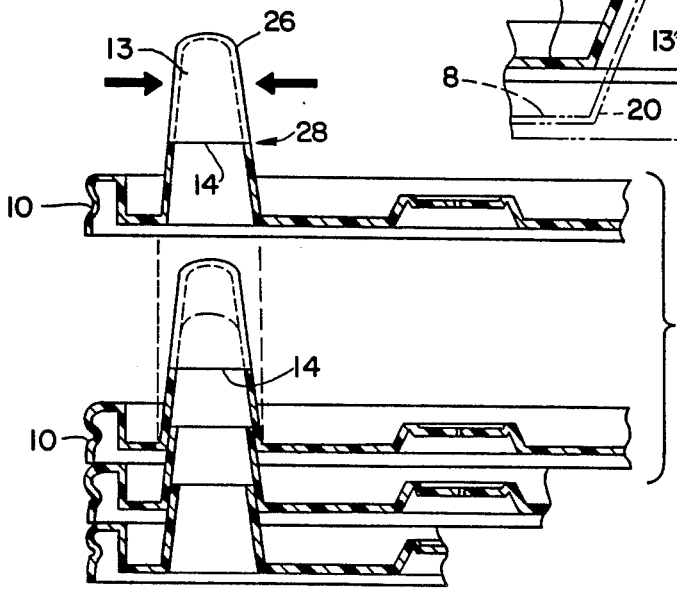
FIG. 17
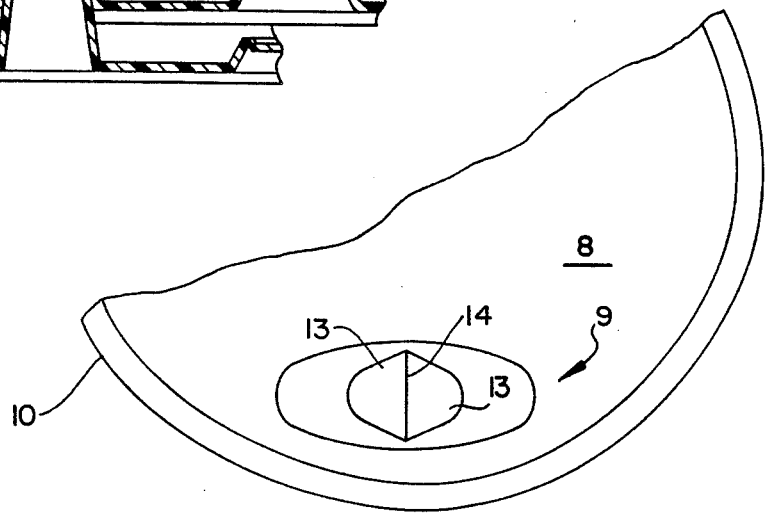
FIG. 18

VALVED CONTAINER CLOSURE

This is a continuation of application Ser. No. 07/208,369, filed Jun. 17, 1988, U.S. Pat. No. 4,828,141, which is a continuation-in-part of application Ser. No. 07/152,537 filed on Feb. 5, 1988, now U.S. Pat. No. 4,782,975.

BACKGROUND AND STATEMENT OF OBJECTS

This invention relates to a closure for a container and is particularly concerned with containers as employed in the so-called fast food industries. Containers of this type are commonly provided with a cup or body and a closure lid. In some arrangements, it is contemplated to remove and discard the lid when access is desired to the food or other material to be supplied in the container. In some instances, a container lid is employed having a deflectable or removable area adapted to be used either directly for drinking or adapted to be opened for insertion of a drinking straw.

In general, prior art arrangements of the kind referred to are not adapted to be reclosed or resealed after they have been opened for use; and in consequence, in the absence of exercise of special handling care, the liquid or material in the container is subject to being inadvertently spilled after the original closure is deflected or disturbed.

It is a major objective of the present invention to provide a closure for a container, particularly adapted to handle liquids, and in which a drinking spout is provided, the drinking spout not only having an aperture for withdrawal of the contained liquid, but also having a valve therein adapted to close when the liquid is not being withdrawn through the spout.

It is a further object of the present invention to provide a arrangement of the kind above referred to in which the valve in the spout is operable by engagement of the lips of the user with the exterior of the spout, thereby providing for automatic opening of the spout when the user desires to withdraw liquid from the container through the spout, and also providing for automatic closing of the valve in the spout when the lips of the user are again separated from the spout.

In addition to the foregoing, it is a further objective of the invention to provide an initial closure tab associated with the spout in relation to the valve so that for purposes of shipment and handling, the closed container will remain substantially sealed until the closure tab is intentionally removed.

It is a further object of the invention to provide a closure which is configured in such a manner as to permit stacking of complementary closures in an array.

BRIEF DESCRIPTION OF THE DRAWINGS

How the foregoing objects and advantages are attained will appear more fully in the following description of the drawings, in which:

FIG. 7 is a perspective view of a closure according to the present invention which is particularly intended for use in closing a container by establishing a frictional fit with the internal container wall, the control valve is shown fragmented below the closure.

FIG. 8 is a fragmentary section through the lines 8—8 of FIG. 7.

FIG. 9 is an illustrative fragmentary section through the lines 3—3 of FIG. 8 and depicts multiple closures to illustrate the stacking feature thereof.

FIG. 10 is a fragmentary top plan view of the closure as depicted in FIG. 7.

FIG. 11 is a perspective view of a closure according to the present invention having a modified valve and spout height which facilitates stacking of multiple complementary lids.

FIG. 12 is a fragmentary section through the lines 12—12 of FIG. 11.

FIG. 13 is an illustrative fragmentary section through the lines 13—13 of FIG. 12 illustrating stacking of the closure.

FIG. 14 is a fragmentary top plan view of the closure depicted in FIG. 11.

FIG. 15 is a perspective view of a closure according to the present invention illustrating modified valve arrangement which facilitates stacking.

FIG. 16 is a fragmentary view through the lines 16—16 of FIG. 15 illustrating the modified valve in a stacking arrangement.

FIG. 17 is a fragmentary sectional view through the lines 17—17 illustrating a stacking arrangement.

FIG. 18 is a fragmentary top plan view of the closure of FIG. 15.

DETAILED DESCRIPTION OF THE DRAWINGS

Figure 1:
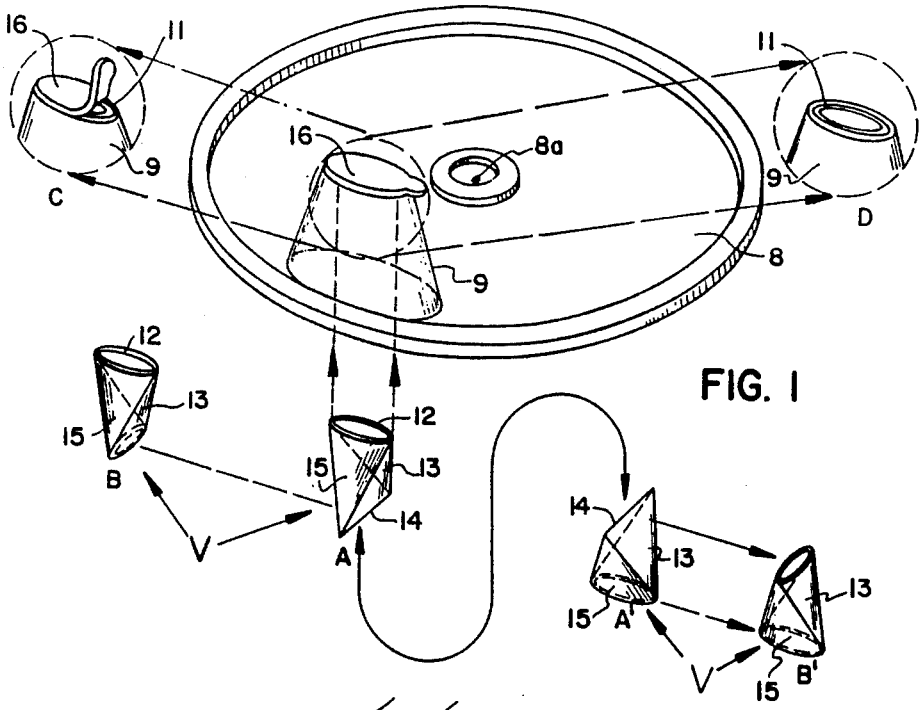
FIG. 1 is an overall perspective view of a lid or closure or container according to the present invention, the lid having a spout adapted to surround or house a control valve, the valve being illustrated in FIG. 1 in separated relation to the lid in several positions below the illustration of the lid itself, as will be explained more fully hereinafter.
Figure 2:
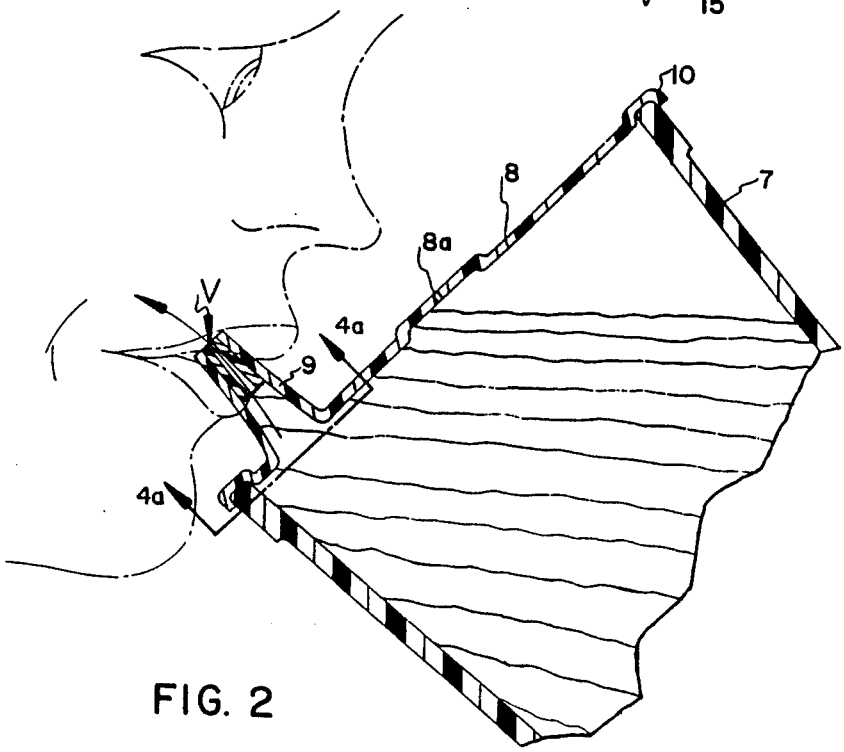
FIG. 2 is a fragmentary sectional view of the upper portion of a cup having a closure or lid according to the present invention, including the spout and the interior valve, this figure showing the valve in opened position, as a result of engagement of the lips of a user.
Figure 3:
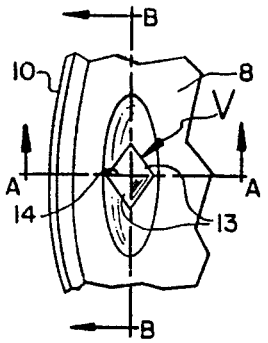
FIG. 3 is a fragmentary view taken as indicated by the section line 3—3 applied to FIG. 2, but showing the parts disengaged from a user and with the interior valve in closed position.
Figure 3A:
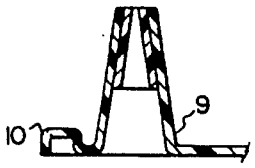
FIGS. 3A and 3B are sectional views taken as indicated by the sections lines A—A and B—B applied to FIG. 3.
Figure 3B:
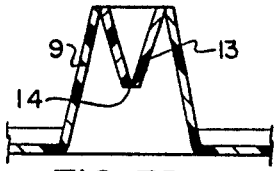
Figure 4:
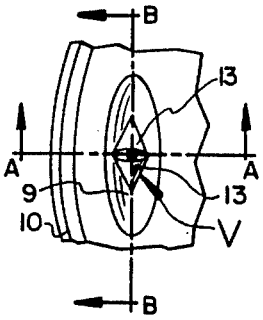
FIG. 4 is a view similar to FIG. 3 taken as indicated by the section line 3—3 applied to FIG. 2, but FIG. 4 shows the valve in opened condition.
Figure 4A:
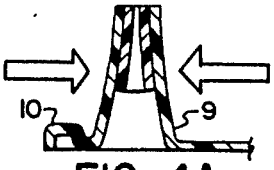
FIGS. 4A and 4B are sectional views taken as indicated by the section lines A—A and B—B applied to FIG. 4, these sectional views also showing the valve in opened condition.
Figure 4B:
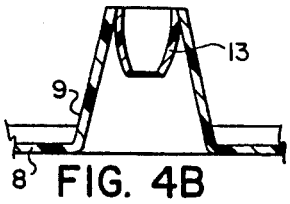

Referring first to FIGS. 1 and 2, the container is indicated by the reference numeral 7, and the lid for the container is indicated at 8. The container may be formed of any desired material, quite commonly a sheet plastic or molded foamed plastic or paper or cardboard;

and the lid may also similarly be formed of materials of the same type. In embodiments such as herein illustrated, in which the spout 9 is integrally molded or formed with the remainder of the lid 8, it is preferred that the material employed have the characteristics of sheet material having substantial flexibility and resiliency so that the spout may readily be compressed by the lips of the user, for the purposes fully described herebelow. As is customary with lids of the kind referred to for containers of the kind referred to, the lid ordinarily has a peripheral groove or socket 10 adapted to receive and interengage with the upper edge of the cup 7 itself.

The spout 9 is connected with the lid and the spout has a flow passage between the interior and the exterior of the cup; and preferably, this flow passage is of ovoid cross section and also of progressively reduced dimensions from the surface of the lid 8 upwardly to the delivery opening 11 (see the figure details indicated by the letters C and D associated with FIG. 1).

Although the spout 9 and the lid may be separately formed or molded and then interconnected, they may also, as is disclosed in FIGS. 1–4, be integrally molded with the remaining structure of the lid.

With the foregoing description of the general arrangement of the lid and the spout in mind, attention is now directed to the four illustrations marked A, B, A′, and B′, these illustrations showing the interior control valve indicated generally by the letter V. This valve is positioned within the spout 9 but is shown in exploded relation to the spout in the illustrations marked A, B, A′ and B′. Certain details of the valve are also more fully disclosed in FIGS. 3, 3A, 3B, 4, 4A and 4B.

The valve is preferably formed of flexible and resilient material, for example, synthetic rubber compositions. The valve has an upwardly presented opening of ovoid shape similar to the ovoid shape of the upper or delivery opening 22 of the spout 9 and fitting just inside of the delivery opening 11 of the spout. The valve further has tapered or inclined 20 surfaces 13—13 (see also FIGS. 3 and 4) converging downwardly and meeting at the lower edge 14 of the valve, as will clearly appear from comparison of FIGS. A and A′ positioned below the main portion of FIG. 1 and also shown in FIGS. 3 and 3B. The valve in opened position is shown in FIGS. B and B′ below the main portion of FIG. 1.

The detail FIG. A and A′ in the lower part of FIG. 1 shows the valve when in the closed or "at rest" position. The valve is opened by application of lip pressure, as indicated by the arrows at the sides of FIG. 4A, this lip pressure being communicated through the side walls of the spout 9, as clearly appears in FIG. 2, and transmitted through the side walls to the walls 15 of the valve V, which lie between the converging walls 13. When this occurs, the side walls 13 of the valve separate from each other in the manner clearly shown in FIGS. 4, 4A and 4B, thereby opening the valve port along the lower edge of the valve and thus provide communication from the interior of the container upwardly through the spout 9. This provides for delivery of the liquid from the container upwardly through the valve and out of the delivery opening 12 of the valve and thus also out of the delivery opening 11 of the spout 9.

When the lip pressure is again released from the side walls of the spout, the converging walls 13 of the valve again move to close the opening along the line 14 at the lower end of the converging walls 13.

The automatic closure of the valve when the lip pressure is released is not only desirable in order to avoid leakage, but when handling heated liquids, is also advantageous in reducing heat loss of the contents of the container.

The foregoing alternate opening and closing of the valve, as a result of the action of the lips of the user, will be fully apparent from comparison of FIGS. 1, 2, 3, 3A, 3B, 4, 4A and 4B.

The lid 8 is desirably provided with a very small aperture, for instance, in the central region, as indicated at 8a in FIGS. 1 and 2, thereby providing for ingress of air as the contents of the cup are being withdrawn through the valve, and thus prevent development of negative pressure within the cup during delivery of the liquid. An appropriate aperture for this purpose need only have very small cross-sectional dimension and will, therefore, not even result in leakage of the liquid under any normal handling conditions.

In the embodiment of FIGS. 1–4, see particularly the detail indicated at the letter C of FIG. 1, a separable tab 16 is initially provided in position overlying the delivery opening 11 of the spout 9, for the purpose of sealing the container for prepackaged products. This tab desirably has adhesive bonding and is readily manually removable in preparation for use of the container and the valved spout. This tab alternately be molded or formed integrally with the spout wall, and arranged for manual separation from the body of the spout.

For effecting the feed operation above described, it is desirable that the spout 9 be formed of sheet material which has some flexibility, and preferably also some resilience so that it will return to the closed position when the lip pressure is released.

The sheet material employed for the valve used within the spout should also be flexible and resilient. This is important so that after opening of the valve by compression under the action of the lips of the user, and subsequent release of the lip engagement, the inclined valve walls 13, which meet along the lower edge 14 when the valve is closed, will return to the "closed" position. When the valve is opened by external pressure applied to the spout, the lower part of the walls 15 move toward each other so that the dimension in the direction of the line 14 is reduced and this causes opening of the valve.

The proportions of the valve itself, and also of the interior of the spout 9, are also configured so as to provide a peripheral sealing interengagement between the outer surface of the valve and the inner surface of the spout in the upper region of the spout and valve. This is important in order to avoid any tendency for leakage from the spout except when the valve is intentionally opened. In the specific embodiments as herein disclosed, it is contemplated that portions of the external surface of the valve itself such as the side walls 15 be adhesively bonded to the interior surface of the spout. With the configurations illustrated in the drawings, this is desirably effected throughout the height of the valve, i.e., throughout the height of the side walls 15. In this way, the rebound of the spout walls after separation of the lips serves to assure reclosing of the valve along the line 14.

As above indicated, the lid and the spout are desirably formed, as by molding, from sheet plastic material. The entire lid, including the spout, may be molded as a single unit or, if desired, the spout and the planar portion of the lid may be separately formed and then interconnected. In any event, the thickness of the material used in the spout should be on the order of from about 0.001" to 0.050", so that the spout may readily be compressed by forces produced by the lip engagement. Compression of the sides of the interior valve V is, of course, also required; and as above indicated, the valve material is desirably resilient, and the thickness of the material used for the valve may also lie within about the range of thickness above referred to for the spout wall.

The wall of the cup 7, on which the lid is employed, may be made of any of a wide variety of materials, one common material used for this purpose being foamed plastic. Material of this type is not only lightweight, but provides adequate strength and rigidity, as is well known.

Figure 5:
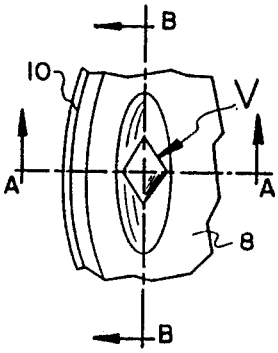
FIGS. 5, 5A and 5B are views illustrating a modification of the arrangement shown in FIGS. 1–4, FIGS. 5A and 5B being taken as indicated by the section lines A—A and B—B applied to FIG. 5 and showing the valve in closed position.
Figure 5A:
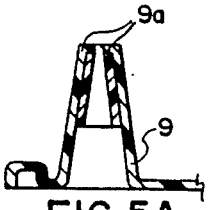
Figure 5B:
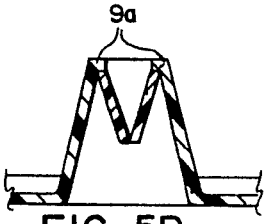

In the alternative embodiment illustrated in FIGS. 5, 5A and 5B, the arrangement of the interior valve and the general configuration of the spout are similar to those described above in connection with the first embodiment. However, in the embodiment of FIGS. 5, 5A and 5B, the upper edge of the spout 9 is provided with an interned flange 9*a* overlying the upper open end of the valve V. This provides a flange surface for interengagement with the upper edge of the open end of the valve, which may be desirable with certain materials in order to stabilize the valve in the spout.

Figure 6:
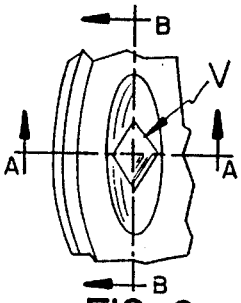
FIGS. 6, 6A and 6B are views of still another embodiment, the views again being similar to FIGS. 3, 3A and 3B, with the sectional views 6A and 6B being taken as indicated by the section lines A—A and B—B applied to FIG. 6 and showing the valve in closed position.
Figure 6A:
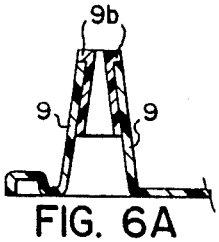
Figure 6B:
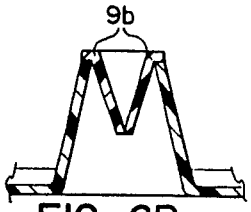

Another alternative for similar purposes is illustrated in FIGS. 6, 6A and 6B. In this embodiment, the upper edge of the valve is provided with laterally extending flanges 9*b* which overlie the upper edges of the spout 9; and this will provide a similar stabilizing action in the relation between the valve and the spout.

With reference to FIG. 7, there is illustrated an alternative embodiment of the invention which is particularly intended to provide for improved stacking of multiple complementary closures in a top to bottom array. The closure 8 is depicted as having a peripheral groove 10 which is intended to establish a compression fit with the interior wall of the container. Except for the valve V, the embodiment of FIG. 7 is very similar to the previously described embodiments.

In the present embodiment, the closure lid 8, spout 9 and valve V are all molded as a unitary structure, see FIGS. 8 and 9. For purposes of illustration, the valve V has been fragmented and dropped below the lid 8 in FIG. 7. From this fragmentary view, it can be seen that the valve V has converging walls or opposed planar terminal portions 13 which converge at the lower edge or valve apex 14. This construction is similar with the prior embodiments.

In the present embodiment the side walls 15 of the valve V do not parallel the outer wall 20 of spout 9 as in prior embodiments, see FIG. 9. Side walls 15 in this embodiment taper inwardly from the outlet portion 24 of spout 9. The valve V and the spout 9 merge at the outlet end as indicated by 24 and form a common open end 26.

As can be seen from FIG. 9, the present embodiment provides a tapered space between the inner surface 22 of spout 9 and side wall 15. Likewise, the length of the valve apex 14 is less than the related coplanar length of the outlet portion 24 of spout 9 and the valve end 28 will pass into the open end of a complementary spout beyond the merger portion 24.

With reference to FIG. 8, it can be seen that the converging walls 13 of valve V are spaced from the inner surface 22 of spout 9.

As can be seen with reference to FIGS. 8 and 9, the present embodiment provides improved stacking of multiple complementary closures in an array which is better suited for packing and shipping of the closures. In stacking, the open end 26 of a first spout 9 will fit within the inlet end 23 of the second spout 9. Likewise, the open end 26 will fit within the space defined between interior surface 22 and side walls 15. The valved end 28 then becomes nested within the spout of the closure immediately beneath it.

With reference to FIG. 10, it can be seen that the present construction provides a valve which is tapered inwardly on all sides toward the lower edge or valve apex 14. Due to the integral nature of the spout and valve, the application of pressure to the spout 9 in the direction as indicated by the arrows in FIG. 9 will be transmitted to the valve apex 14 and the valve will be open to permit dispensing of the fluid. In the event of accidental tipping of the container, the nesting of the spout about the valve V will provide further shock absorbency to avoid accidental opening of the spout. It will be understood by those skilled in the art that a force which is sufficient to dislodge the lid or to damage the seal between the closure and the container will still result in accidental fluid discharge.

With reference to FIG. 11, there is illustrated an alternative embodiment of the invention which is particularly intended to provide for reduced valve size in the spout and to provide for some stacking of multiple complementary closures in a top to bottom array. The closure 8 is depicted as having a peripheral groove which is intended to fit about the rim of a container as discussed with previous embodiments. Except for the valve V, the embodiment of FIG. 11 is very similar to the previously described embodiments.

In the present embodiment, the closure lid 8, spout 9 and the valve are all molded as a unitary structure, see FIGS. 12 and 13. For the purposes of illustration, the valve V has been fragmented and dropped below the lid 8 in FIG. 11. From this fragmentary view, it can be seen that the valve V has converging walls or opposed planar terminal portions 13 which converge at the lower edge or valve apex 14. This construction is similar to those previously described, however, in the present embodiment the side walls, previously identified as 15, of the valve V have been eliminated and are replaced by the wall 20 of the spout 9.

With reference to FIGS. 12 and 13, it can be seen that the opposed planar terminal portions 13 taper inwardly toward the lower edge or valve apex 14 to produce the valve end 28. This is consistent with prior embodiments. However, in this embodiment, the merger at 24 coincides with open end 26. This effectively produces the inverted W instant cross section as shown in FIG. 12. The arcuate portions of the ovoid shaped spout serve the function of the end walls 15 which have been eliminated by this construction.

With reference to FIG. 13, it can be seen that the lower edge or valve apex 14 extends across the interior of the spout 9. Accordingly, efforts to stack closures according to this embodiment are limited by the abutment of open end 26 of a first spout against the valve end 28 of the prior spout.

As noted the instant section of the valved spout, shown in FIG. 12, will appear as an inverted W with the opposed terminal portions converging at the ape thereof to form the valve apex. Since the valve apex extends across the spout, it will be the determining factor in controlling the degree of stacking. Accordingly, the valve apex 14 should be ideally placed as close to the open end 26 as is consistent with the resilience of the selected material.

FIG. 14, a top plan view clearly shows the relationship of planes 13 with respect to the walls 20.

With respect to FIG. 15, there is shown a further embodiment of the present invention which is particularly adapted for stacking. The closure 8 is similar to those previously described, however, the spout and valve arrangement is different. The spout and valve are of a unitary construction with the closure, as previously described, however, the spout has been modified by the addition of notch 30, see FIG. 15. The sides of the notch 30 are defined by the converging planes 13 which define the terminal portions of the valve. As can be seen more clearly with reference to FIG. 16, the valve in cross section resembles an inverted W shape. This is similar to the view of FIG. 12, however, the present embodiment does not incorporate the arcuate portions of the spout. Accordingly, the external portions of the spout 9 generally define an inverted W shape. As with previous embodiments, the opposed planar terminal portions 13 converge at valve apex 14. As can be seen with reference to FIG. 16, the modification of spout 9 so that the outward configuration thereof parallels the configuration of the valve results in a condition of improved stacking of complementary lids. Likewise, the location of the valve immediately adjacent the free end of the spout provides the maximum stacking area beneath the valve.

As can be seen with reference to FIG. 17, multiple closures may be stacked in the usual array. In practice, that portion of the closure which forms the peripheral groove 10 is generally pliable enough so that closures may be stacked in a nested fashion one upon the other. In such a condition, the apex 14 of a first valve would move into virtual abutment with the apex of the closure beneath it. Thus, the valved spout is comprised of a body portion which defines the spout exterior and valved portion which closes the spout.

As can be appreciated by comparing the various embodiments, the embodiment of FIGS. 15 through 18 provides the greatest degree of stackability. Since the ability to stack is improved, the overall height of the spout 9 is not as critical and the spout may be produced in a height sufficient to assure that the valve end 28 of the spout will easily reach into the user's mouth.

It will be understood that certain terms have been used as terms of description and not of limitation and that the scope of the invention is defined by the claims.

What I claim is:

1. A valved spout for controlled dispensing of a liquid from a container, said spout comprised of an outer resilient member having inlet and outlet ends and a body segment which defines the exterior of said spout and an inner member having downwardly depending opposed portions that close the outlet end of said outer member and terminate in an apex valve.

2. The valved spout of claim 1 wherein said apex valve is opened by the application of force in a direction edgewise to said opposed portions.

3. A stackable container lid having a valved spout for controlled dispensing of a liquid from a container, said spout comprising:

an outer resilient member having a fixed end, a body segment and a free end, said body segment tapered from the fixed end toward the free end and defining the exterior of said spout, and an inner resilient member having downwardly depending opposed portions which close said free end and terminate in an apex valve.

4. An individual beverage package comprising:

a beverage container;

a quantity of a consumable beverage within said container; and a container closure including a mouth-operable valved drinking spout, said spout further including:

a tubular body having a first and communicating with the interior of said container and a second end for engagement by the user's mouth; and an apex value means disposed within said tubular body proximate said second end, said apex valve means comprising portions depending downwardly from said second end and terminating inwardly of said first end, said apex value means being selectively operable between opened and closed positions by the application to and release of pressure from said tubular body.

5. A stackable container lid comprising:

a body having means for sealingly engaging a container rim;

a mouth-operable valved drinking spout having a first end attached to said body for communication with the interior of the container and a second end extending from said body for engagement by a user's mouth;

an apex valve disposed within said spout proximate said second end and defining a cavity within said second end;

said valve being selectively operable such that the application of pressure to said tubular body by the user's mouth opens said valve and such that release of said mouth pressure causes said valve to close;

said spout tapered from the first end toward the second end such that the second end of a like spout is inserted within the first end of the spout and is nested therewith.

* * * * *

UNITED STATES PATENT AND TRADEMARK OFFICE

CERTIFICATE OF CORRECTION

PATENT NO. : 4,946,062

DATED : August 7, 1990

INVENTOR(S) : Peter Coy

It is certified that error appears in the above-identified patent and that said Letters Patent is hereby corrected as shown below:

Column 1, lines 37-38, after the word "provide", delete "a" and insert --an--.

Column 2, line 52, between the words "illustrating modified", insert the word --a--.

Column 3, line 41, delete the numeral "20".

Column 6, line 66, delete "ape" and insert --apex--.

Column 8, line 24, Claim 4, delete "and" and insert --end--.

Signed and Sealed this

Sixth Day of August, 1991

*Attest:*

HARRY F. MANBECK, JR.

*Attesting Officer*

*Commissioner of Patents and Trademarks*